US008202059B1

(12) United States Patent
Javadi

(10) Patent No.: US 8,202,059 B1
(45) Date of Patent: Jun. 19, 2012

(54) SYSTEM AND METHOD FOR PRESSURIZING FLUIDS

(76) Inventor: Shervin Javadi, Monte Sereno, CA (US)

( * ) Notice: Subject to any disclaimer, the term of this patent is extended or adjusted under 35 U.S.C. 154(b) by 961 days.

(21) Appl. No.: 12/080,046

(22) Filed: Mar. 31, 2008

Related U.S. Application Data

(60) Provisional application No. 60/920,987, filed on Mar. 30, 2007.

(51) Int. Cl.
*F04F 1/06* (2006.01)

(52) U.S. Cl. ..... 417/118; 277/331; 277/583

(58) Field of Classification Search ..... 417/118; 277/331, 334, 583, 645, 646; 137/212
See application file for complete search history.

(56) References Cited

U.S. PATENT DOCUMENTS

| | | | | |
|---|---|---|---|---|
| 1,409,346 | A * | 3/1922 | Kobel | 417/54 |
| 2,681,706 | A * | 6/1954 | Pottorf | 277/333 |
| 3,676,567 | A * | 7/1972 | Zinn | 174/37 |
| 4,455,027 | A * | 6/1984 | Baski | 277/334 |
| 6,415,659 | B1 * | 7/2002 | Mioduszewski et al. | 73/152.23 |
| 2005/0274824 | A1 * | 12/2005 | Brooke et al. | 239/398 |
| 2009/0208372 | A1 * | 8/2009 | Mott et al. | 422/68.1 |

* cited by examiner

*Primary Examiner* — Devon C Kramer
*Assistant Examiner* — Dnyanesh Kasture
(74) *Attorney, Agent, or Firm* — Kilpatrick Townsend & Stockton LLP

(57) ABSTRACT

A system for pressurizing fluids is provided. The system includes a container with an open end and a closed end. The container contains the fluids to be pressurized. The system further includes a dynamic seal capable of expanding to facilitate sealing of the open end of the container. The system also includes a tube arrangement passing through the dynamic seal into the container. The tube arrangement facilitates passage of a first pressurizing medium to pressurize the fluids.

13 Claims, 10 Drawing Sheets

SECTION A-A

SECTION B-B

SYSTEM AND METHOD FOR PRESSURIZING FLUIDS

This patent application claims priority from the provisional patent application 60/920,987 filed on Mar. 30, 2007. The invention disclosed here relates in general to a field of devices using pressurized fluids, and more particularly, to system and method for pressurizing fluids.

FIELD OF INVENTION

Background

In laboratories, while analyzing a sample, many times the sample has to be pressurized in order to perform certain tests on the sample. For example, a sample of a fluid such as urine can be pressurized to obtain a thin stream of the sample, to stir the sample in order to uniformly mix it with a chemical/liquid or to cause the sample to rise in a tube/straw. For instance, in a flow cytometer, a sample fluid, such as, blood, can be pressurized to obtain a thin stream for analyzing cell count, platelet count, and/or the density of the sample. Further, before pressurizing the sample, a container containing the sample has to be sealed properly. Proper sealing of the container such as a test tube or a conical flask is necessary to pressurize the sample to the desired level. As per existing techniques, sealing of the container can be done by use of o-rings and other static seals. For example, in the flow cytometer, the test tube holding the sample is sealed with the help of an o-ring or a BAL™ seal before the test tube is pressurized.

Although the container can be sealed using o-rings or other static seals, there are some limitations associated with this approach. The static seals tend to wear out as a function of their usage. The friction between the container and the static seals is the major cause of the wear. Further, engaging and disengaging the container with the static seals is also a tedious job. In manual operation, the person operating the container has to be cautious while engaging or disengaging the container. Also, the chances of damage to the container are greater. For example, the test tube containing the sample fluid might break due to application of extra pressure on the test tube while engaging the o-ring with the test tube. This can lead to loss of the sample fluid to be analyzed.

Where an auto-loader system is used for engaging and disengaging the container, complex mechanical and electronic systems are required to perform the desired actions. Moreover, the auto-loader system requires electronic or pneumatic actuators not only to engage, but also to disengage the container.

In light of the foregoing discussion, there is a need of a simple system and method for pressurizing fluids that can prevent the wear and tear of the seals. Further, the system should reduce the chances of breakage and damage of the unit, while increasing the life of the seal. Moreover, the system should simplify the engaging and disengaging of the tube using an auto-loader.

SUMMARY OF THE INVENTION

An object of the present invention is to provide a system for pressurizing fluids with a dynamic seal for sealing the container that minimizes the friction between the container and the dynamic seal during insertion and removal.

Another object of the present invention is to provide a system for pressurizing fluids with a dynamic seal that facilitates engaging and disengaging of the container and to overcome the problem of breakage of container and loss of sample due to application of extra pressure while engaging and disengaging the container and the dynamic seal.

Yet another object of the present invention is to provide a holder that eliminates the need of complicated auto-loader systems required for engaging and disengaging a container and an interference seal.

To achieve the objects of the present invention, in an embodiment of the present invention a system for pressurizing fluids is provided. The system includes a container with an open end and a closed end. The container contains the fluids to be pressurized. Further, the system includes a dynamic seal that is capable of expanding to facilitate sealing of the open end of the container. Furthermore, the system includes a tube arrangement passing through the dynamic seal into the container that facilitates passage of a first pressurizing medium to pressurize the fluids.

In another embodiment of the present invention a system for pressurizing fluids is provided. The system includes a container with an open end and a closed end. The container contains the fluids to be pressurized. Further, the system includes a dynamic seal facilitating sealing the open end of the container. Furthermore, the system includes a tube arrangement passing through the dynamic seal into the container that facilitates passage of a first pressurizing medium to pressurize the fluids. The tube arrangement lies along a first axis substantially parallel to a longitudinal direction of the container. Additionally, the system includes a holder capable of rotating in clockwise and counter-clockwise directions about a second axis substantially perpendicular to the first axis. The holder provides support to the closed end of the container while disengaging the container and the seal. Further, the rotating of the holder facilitates engaging and disengaging of the container and the seal.

In yet another embodiment of the present invention a method for pressurizing fluids in a container is provided. The container has an open end and a closed end and it contains the fluids to be pressurized. The method includes positioning a dynamic seal at a pre-determined position. The dynamic seal is capable of expansion using a pressurizing medium. A tube arrangement is passing through the dynamic seal. The method further includes positioning at least a portion of the open end of the container around the dynamic seal. The tube arrangement passes through the dynamic seal and into the container. Further, the method includes expanding the dynamic seal using the pressurizing medium to facilitate engagement of the dynamic seal and the container. Furthermore, the method includes passing another pressurizing medium through the tube arrangement to pressurize the fluids in the container.

BRIEF DESCRIPTION OF THE DRAWINGS

The preferred embodiments of the invention will hereinafter be described in conjunction with the appended drawings provided to illustrate and not to limit the invention, wherein like designations denote like elements, and in which.

DESCRIPTION OF PREFERRED EMBODIMENTS

While the preferred embodiments of the invention have been illustrated and described, it will be clear that the invention is not limited to these embodiments only. Numerous modifications, changes, variations, substitutions and equivalents will be apparent to those skilled in the art without departing from the spirit and scope of the invention.

In an embodiment, a system for pressurizing fluids is provided. The system includes a container containing the fluid(s) to be pressurized, such as a test tube, using a first pressurizing medium. Further, the system includes a dynamic seal capable of sealing the container. Furthermore, the system includes a tube arrangement to pressurize the fluids in the container using a first pressurizing medium. Additionally, the tube arrangement includes an inlet to pressurize the dynamic seal using a second pressurizing medium. The inlet to pressurize the dynamic seal is connected to a source of the second pressurizing medium. Moreover, the system includes a holder to prevent the container from slipping off. After the container is installed, the holder keeps the container in place until the dynamic seal is pressurized.

In another embodiment, a dynamic seal for sealing a container is provided. The dynamic seal is capable of expansion when the dynamic seal is pressurized with the first pressurizing medium.

In another embodiment, a method for pressurizing fluids is provided. The method includes assembling a container with an arrangement for pressurizing the fluids, for example, a laboratory arrangement to pressurize fluids, such as a flow cytometer. The container contains the fluids to be pressurized. Further, the method includes sealing the container using a dynamic seal. Finally, the method includes pressurizing the fluids contained in the container.

Figure 1:
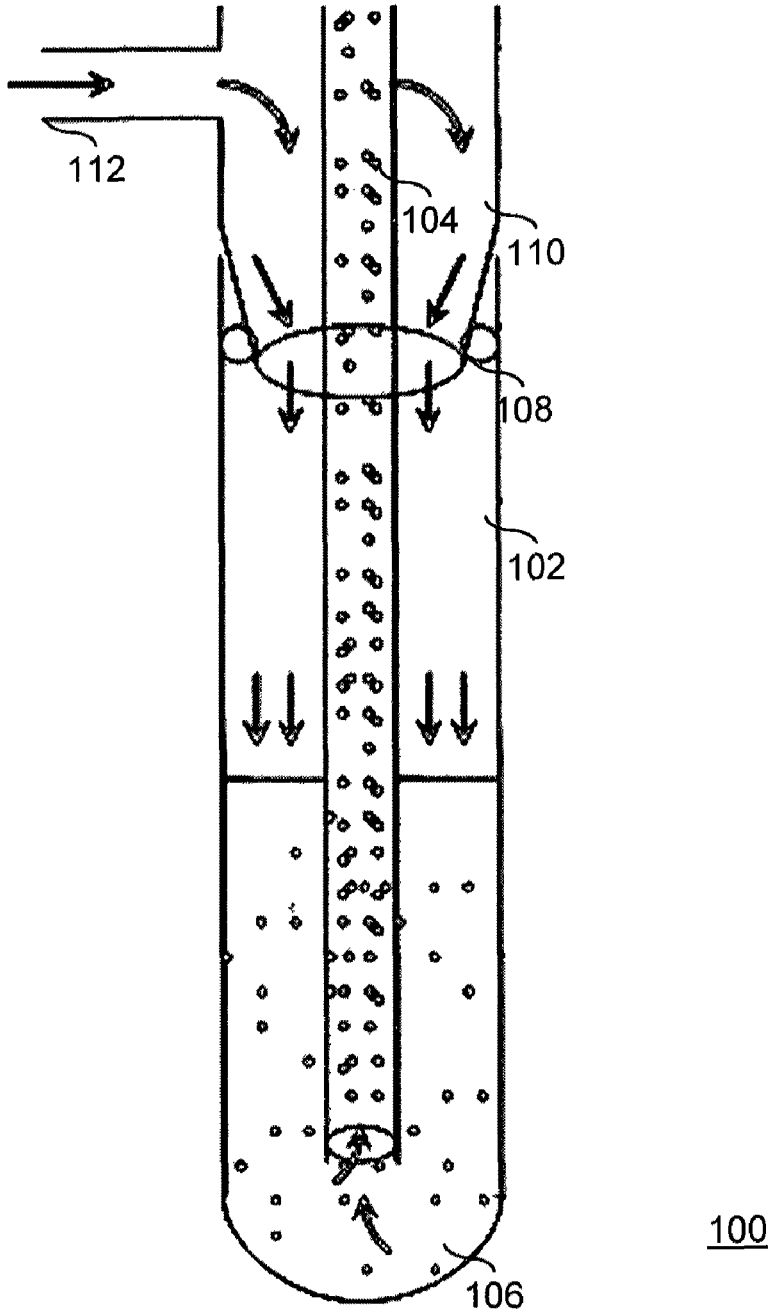
FIG. 1 (PRIOR ART)
FIG. 1 illustrates an arrangement for pressurizing fluids, as per the state of the art (prior art) before this invention.

FIG. 1 illustrates an arrangement 100 for pressurizing fluids, as per the state of the art (prior art) before this invention. The arrangement 100 includes a container 102, a straw 104, a fluid 106 to be pressurized, an o-ring 108, a converging portion 110, and an inlet 112. Examples of the container 102 can include, but are not limited to, a test tube and a conical flask. However, for the sake of clarity the container 102 is shown as a test tube in the FIG. 1.

In one embodiment, the fluid 106 is filled in the test tube 102 (container). Examples of the fluid 106 can include, but are not limited to, blood, urine, saliva, and any other fluid to be analyzed. After filling the fluid 106 in the test tube 102, one end of the straw 104, passing through the converging portion 110, is inserted in the fluid 106. The one end of the straw 104 is inserted in the fluid 106 to cause the fluid 106 rise into the straw 104 when the test tube 102 is pressurized. Further, before pressurizing, the test tube 102 is sealed with the converging portion 110 using the o-ring 108. The o-ring 108 is used to ensure that the gap between the test tube 102 and the converging portion 110 is properly sealed. Examples of the converging portion 110 can include, but are not limited to, the converging portions of the laboratory equipments, a funnel, a pipette, a cuvette, and so forth.

In an arrangement of this embodiment, the test tube can be engaged manually. A person performing the analysis can manually engage the test tube 102 with the converging portion 110. Further, after the analysis is over, the person can disengage the test tube 102 by pulling it down. For another arrangement of this embodiment, the test tube 102 can be engaged with the help of an auto-loader. The auto-loader is an automatic machine capable of engaging the test tube 102 with the help of complex mechanisms and assemblies. The auto-loader can include electronically operated components such as solenoids and pneumatic cylinders to push the test tube 102 upwards and engage it with the converging portion 110. Further, the auto-loader needs additional complexity for disengaging the test tube 102 after the analysis is over.

However, engaging and disengaging becomes difficult because of the friction present between the test tube 102 and the o-ring 108. The friction, apart from making engaging and disengaging difficult, also wears out the o-ring 108 during the process.

After the test tube 102 has been engaged, a first pressurizing medium such as air can be forced into the test tube 102 from the inlet 112. Further, the pressurizing medium can exert pressure on the fluid 106 to cause the fluid 106 rise in the straw 104. The fluid 106 in the straw 104 can be used for analysis.

Figure 2:
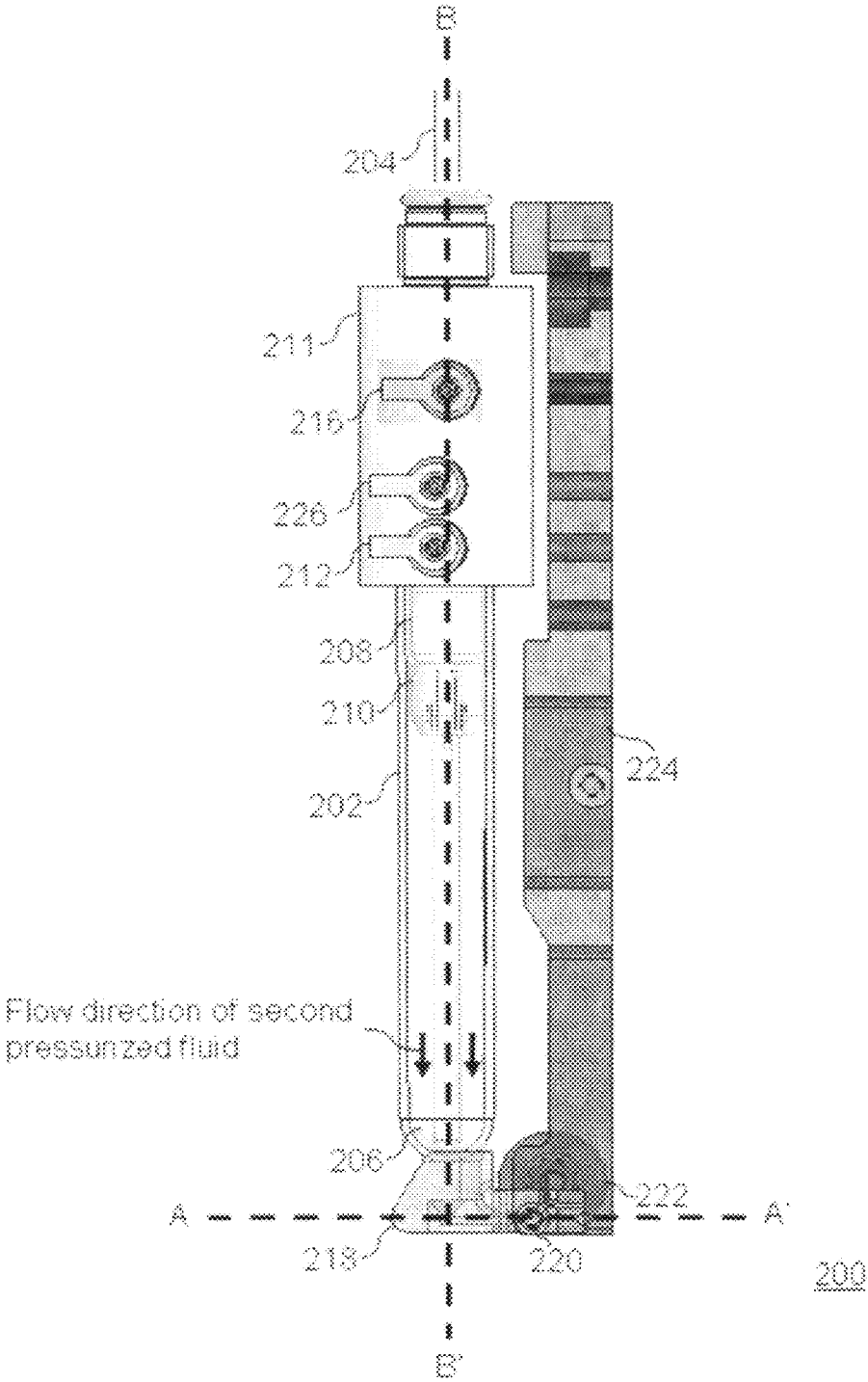
FIGS. 2 and 3 illustrate an arrangement for pressurizing fluids, in accordance with an embodiment of the present invention.
Figure 3:
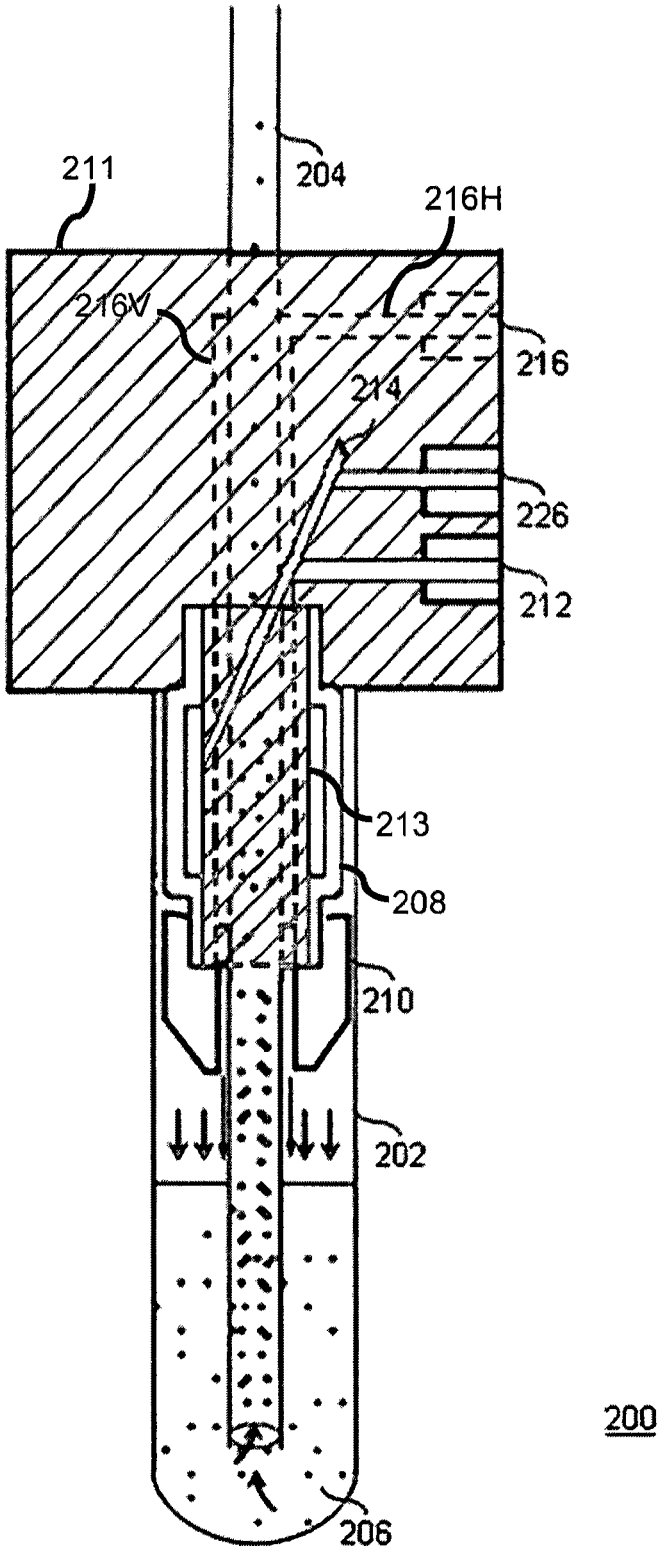

FIGS. 2 and 3 illustrate an arrangement 200 for pressurizing fluids, in accordance with an embodiment of the present invention. FIG. 2 illustrates a front view of the arrangement 200 and FIG. 3 illustrates a schematic cross-sectional view of the arrangement 200. The arrangement 200 is shown to include a container 202, a tube arrangement 204, a fluid 206 to be pressurized, a dynamic seal 208, a nut 210, a pressurizing unit 211, a holder 218, a torsion spring 220, a locking arrangement 222, and a stand 224. The pressurizing unit 211 (explained in detail in conjunction with FIGS. 4, 5 and 6) includes an inlet port 212 to pressurize the dynamic seal 208, an outlet port 226 to depressurize the dynamic seal 208, a connecting tube 214 (see FIG. 5 as well), a pressurization port 216 to pressurize the fluid 206 and a body portion 213 to connect the dynamic seal 208 with the pressurizing unit 211. The dynamic seal 208 can be slid over the body portion 213. The connecting tube 214 connects the inlet port 212 and the outlet port 226 with a hollow space in between an inner wall of the dynamic seal 208 and an outer wall of the body portion 213, as shown in FIG. 3.

Further, the pressurization port 216 has a horizontal portion 216H and a vertical portion 216V. The vertical portion 216V of the pressurization port 216 is concentric with the tube arrangement 204, as shown in FIG. 3. In an embodiment of the present invention the dynamic seal 208 can be in an interference fit with the body portion 213. In another embodiment, the dynamic seal 208 can be in a loose fit with the body portion 213 and is held at the desired position with the help of the nut 210. Those with ordinary skill in the art will appreciate that the arrangement 200 may include all or even a fewer number of components than the components shown in FIGS. 2 and 3. Further, those with ordinary skill in the art will understand that the arrangement 200 may include additional components that are not shown here and are not germane to the operation of the arrangement 200, in accordance with the inventive arrangements. Furthermore, the arrangement 200 can be used independently or as a sub-part in any laboratory instrument such as a flow cytometer.

In one embodiment, the container 202 carries the fluid 206 to be analyzed. For the sake of clarity in explanation, the container 202 is shown as a test tube in the FIGS. 2 and 3.

However, the container 202 can be any laboratory instrument such as a conical flask, a beaker, and any other laboratory instrument. Further, the test tube 202 (container) can be pushed up in order to insert one end of the tube arrangement 204 in the fluid 206. In one example of this embodiment, the test tube 202 can be pushed up by a person operating the arrangement 200. In this arrangement, while the person is pushing the test tube 202, the holder 218 can be rotated in a counter clockwise direction, from the position shown in FIG. 2, to move out of the way. In another example of this embodiment, the test tube 202 can be pushed up by an auto-loader. In this arrangement also the holder 218 can rotate to align itself parallel to the stand 224 along a first axis (B-B' axis) to provide way to the test tube 202. The holder 218 rotates clockwise in this arrangement. Further, the holder 218 can rotate back, to align itself parallel to a second axis (A-A' axis), perpendicular to the first axis (B-B' axis), either due to gravity or due to action of the torsion spring 220. After the holder 218 has rotated back the holder 218 can be locked so as to prevent the test tube 202 from slipping off. The holder 218 can be locked by using a locking arrangement 222 such as a solenoid or a pneumatic cylinder. In case of an auto-loader, the test tube 202 can also be pressurized without a support from the holder 218. When the auto-loader lowers the test tube 202, the holder 218 drops back to the original position, i.e., parallel to A-A' axis.

After the test tube has been positioned, a second pressurizing medium such as air can enter from the inlet port 212 and flow through the connecting tube 214 to pressurize the dynamic seal 208. Other examples of the second pressurizing medium may include, but are not limited to, water and silicone grease. The second pressurizing medium can be pressurized with the help of a pressure source (Not shown in the figure). Examples of the pressure source may include a positive volume-displacement device such as a syringe pump, or any other pressure source with or without a pressure regulating device that can apply the same pressure. Further, selection of the second pressurizing medium can be done on the basis of the permeability of the dynamic seal 208. For example, where the dynamic seal 208 is permeable to air and/or water, silicone grease can be used as the second pressurizing medium.

Further, the dynamic seal 208 can be made of polymers like silicone or nitriles which are capable of providing elasticity as well as strength. Elasticity is desired as the dynamic seal 208 changes shape when the second pressurizing medium is blown in. Further, the dynamic seal 208 can regain its original or nearly original shape once the dynamic seal 208 is depressurized. Furthermore, the diameter, wall thickness, and length of dynamic seal 208 can be designed to allow the dynamic seal 208 to expand to different dimensions at different internal pressures applied to the test tube 202.

In case of manual operation, the inlet port 212 can be activated by the person operating the arrangement 200. For example, the person operating the arrangement 200 can initiate the expansion/activation of dynamic seal 208 by pressing a button/switch to switch 'ON' the supply of second pressurizing medium through the inlet port 212. Further, in case of the auto-loader, the inlet port 212 can be activated based on an input from the locking arrangement 222. For example, after the locking arrangement 222 has locked the holder 218 at the desired position, a signal is sent to the inlet port 212. Based on the signal, the inlet port 212 allows the second pressurizing medium to flow in and pressurize the dynamic seal 208.

In one embodiment, a constant supply of the second pressurizing medium is required to pressurize the dynamic seal 208. The dynamic seal 208 is kept in a pressurized state for the time the dynamic seal 208 is required to seal the test tube 202. For example, a compressor providing a supply of pressurized air, acting as the second pressurizing medium, is switched 'ON' for the entire time period the dynamic seal 208 is required to be active. In another embodiment, the supply of the second pressurizing medium is required only once. In this embodiment, the inlet port 212 includes a one-way valve, which allows the second pressurizing medium to flow only from the supply of second pressurizing medium to the dynamic seal 208. Further, the reverse flow is restricted by the one-way valve. Furthermore, the second pressurizing medium is retained by the dynamic seal 208 as long as the dynamic seal 208 is required to seal the test tube 202.

After the dynamic seal 208 has sealed the test tube 202, a first pressurizing medium such as air can be forced into the test tube 202 from the pressurization port 216. The first pressurizing medium can be pressurized with the help of a pressure source (Not shown in the figure). Examples of the pressure source may include a positive volume-displacement device such as a syringe pump, or any other pressure source with or without a pressure regulating device that can apply the same constant pressure. Further, the first pressurizing medium can exert pressure on the fluid 206 to cause the fluid 206 to rise in the tube arrangement 204. For example, the fluid 206 can, thereafter, be passed through the converging section of a flow cytometer to obtain a thin stream of the fluid 206. The thin stream of the fluid 206 can be used for analysis of the fluid 206. The fluid 206 can be analyzed for counting, examining and sorting microscopic particles suspended in the thin stream of the fluid 206.

In most cases the pressure exerted by the first pressurizing medium should be less than the pressure of the second pressurizing medium. This is required so that the dynamic seal 208 can remain in place, when the test tube 202 is pressurized. For example, the second pressurizing medium should be at a pressure range of 8-20 pounds per square inch (psi) to sustain a pressure of 3 psi in the test tube 202.

In the embodiment where a constant supply of the second pressurizing medium is required to pressurize the dynamic seal 208, the dynamic seal 208 can be deactivated by switching 'OFF' the constant supply of the second pressurizing medium and releasing away the second pressurizing medium stored in the dynamic seal 208. For example, the dynamic seal 208 can be deactivated by switching 'OFF' the compressor providing constant supply of the second pressurizing medium, followed by release of the second pressurizing medium from the dynamic seal 208 through the connecting tube 214 and the outlet port 226. In another embodiment, the dynamic seal 208 can be deactivated by releasing the second pressurizing medium via the outlet port 226 for depressurizing the dynamic seal 208. The outlet port 226 can include a solenoid-operated valve. The solenoid-operated valve, when activated, allows the second pressurizing medium to flow from the dynamic seal 208 to the atmosphere or sink. Thereafter, the seal attains the original (unexpanded) or nearly original shape. For one embodiment, the solenoid-operated valve can be activated with the help of a switch. For example, the person operating the arrangement 200 can depressurize the dynamic seal 208 by pressing a button/switch. This can activate the solenoid-operated valve associated with the outlet port 226 and the second pressurizing medium can flow out. In an embodiment, a single port can perform the functions of inlet port 212 and the outlet port 226. For example, a three-way valve can be used to pressurize and depressurize the dynamic seal 208. In this embodiment, the three-way valve can be used for both pressurizing and depressurizing the dynamic seal 208.

After the dynamic seal 208 has been depressurized, the test tube 202 can be removed either manually or with the help of the auto-loader. In case of the auto-loader, while removing the test tube 202, the holder 218 can rotate counter clockwise, from a position where it was rotated up and parallel to B-B' axis during insertion to the position shown in FIG. 2, to align itself parallel to the A-A' axis. Further, in case of manual operation, the holder 218 can be rotated in counter-clockwise direction to pull the test tube 202 back. After removing the test tube 202, the holder 218 can rotate back to align itself parallel to the A-A' axis due to action of the torsion spring 220. The motion of the holder 218 is in opposite directions for the manual and the auto-loading mode during insertion.

In embodiment, the holder 218 is also capable of acting as a drain. The holder 218 can act as a drain when the tube arrangement 204 is being rinsed to remove the traces of last analyzed fluid after the test tube 202 has been disengaged from the dynamic seal 208. Further, the holder includes a passage for flow of the rinsed fluid. For example, after a sample of urine has been analyzed and the test tube 202 disengaged from the dynamic seal 208, the tube arrangement 204 can be rinsed with the help of water. Further, the rinsed water can flow from the passage inside the holder 218 to the drain. In this embodiment, the holder 218 can be locked in the original position, i.e., parallel to the A-A' axis, before the tube arrangement 204 is rinsed. Locking is desirable to prevent the person (or an auto-loader) operating the arrangement 200 from installing a new test tube when the tube arrangement 204 is being rinsed.

Figure 4:
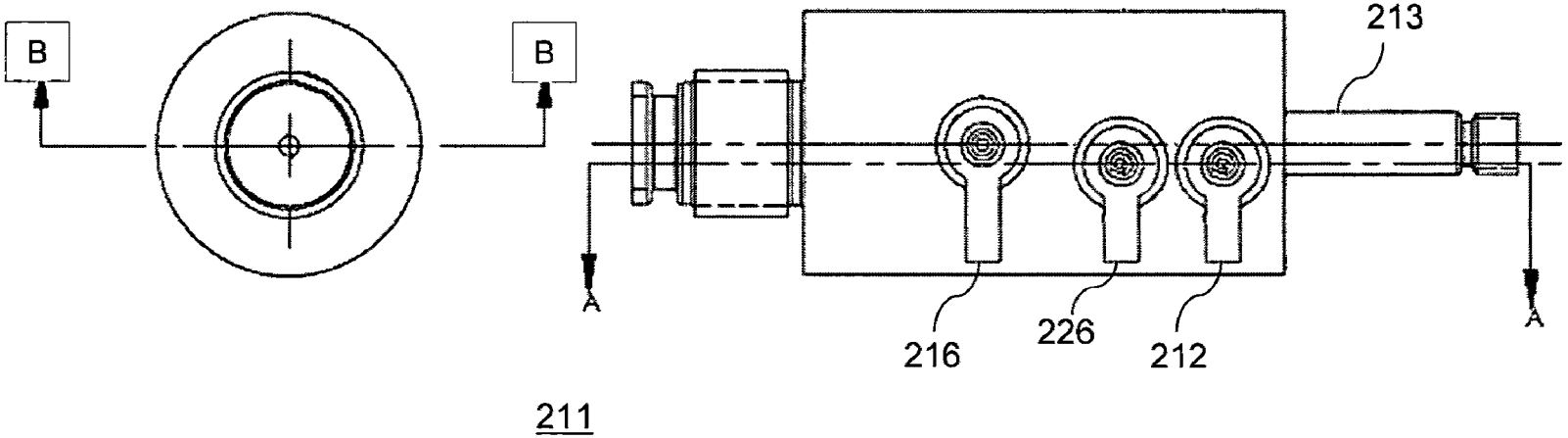
FIG. 4 illustrates orthogonal views of a pressurizing unit, in accordance with an embodiment of the present invention.

FIG. 4 illustrates orthogonal views of the pressurizing unit 211. A top view of the pressurizing unit 211, as shown in FIG. 4, depicts a sectional plane B-B. The sectional plane B-B passes through the horizontal portion 216H and the center of the tube arrangement 204, the vertical portion 216V and the body portion 213 and lies along the center of the pressurizing unit 211. A side view of the pressurizing unit 211, as shown in FIG. 4, depicts a sectional plane A-A. The sectional plane A-A passes through the inlet port 212, the outlet port 226 and the connecting tube 214 and lies at a fixed distance from the center of the pressurizing unit 211.

Figure 5:
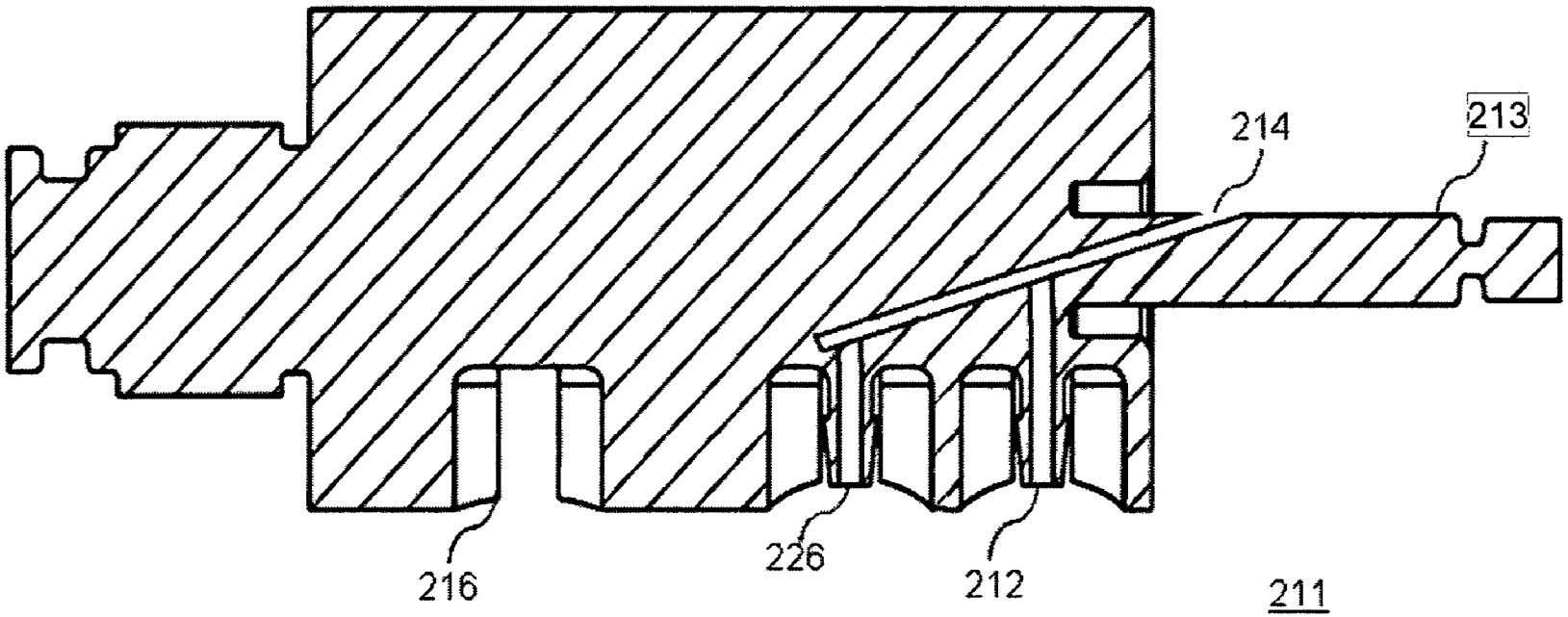
FIG. 5 illustrates a cross-sectional view of the pressurizing unit along a sectional plane A-A, as depicted in the FIG. 4.

FIG. 5 illustrates a schematic cross-sectional view of the pressurizing unit along a sectional plane A-A of FIG. 4. The sectional plane A-A passes through the inlet port 212, the outlet port 226 and the connecting tube 214. Further, the sectional plane A-A lies at a fixed distance from the center of the pressurizing unit 211.

Figure 6:
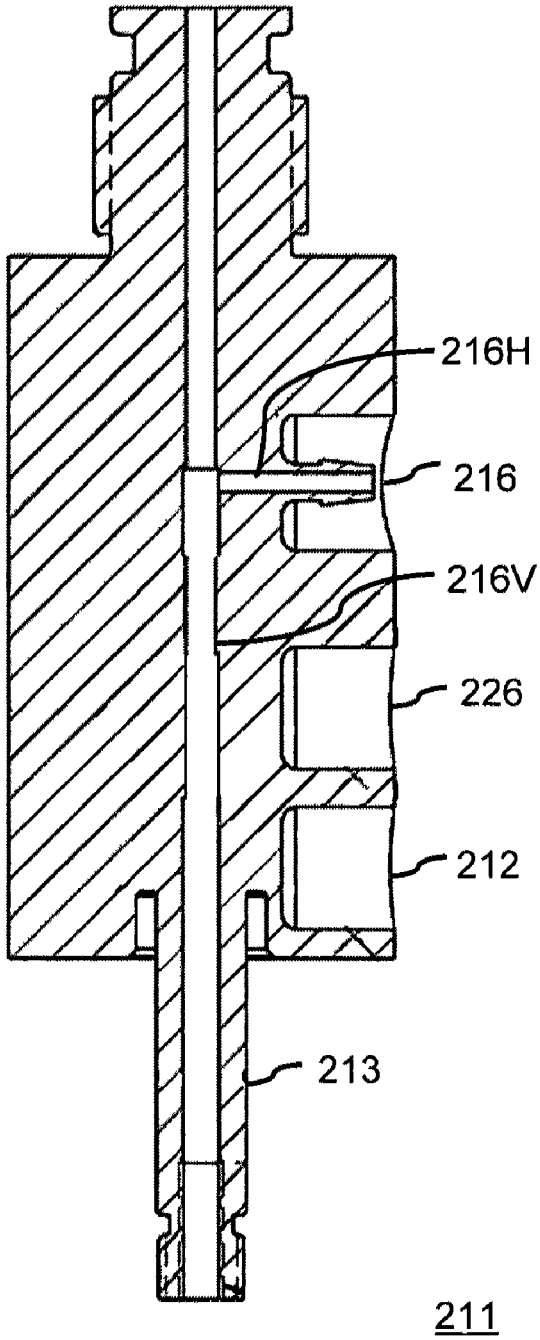
FIG. 6 illustrates a cross-sectional view of the pressurizing unit along a sectional plane B-B, as depicted in the FIG. 4.

FIG. 6 illustrates a schematic cross-sectional view of the pressurizing unit along a sectional plane B-B of FIG. 4. The sectional plane B-B passes through the horizontal portion 216H and the center of the tube arrangement 204, the vertical portion 216V and the body portion 213. Further, the sectional plane B-B lies along the center of the pressurizing unit 211.

Figure 7:
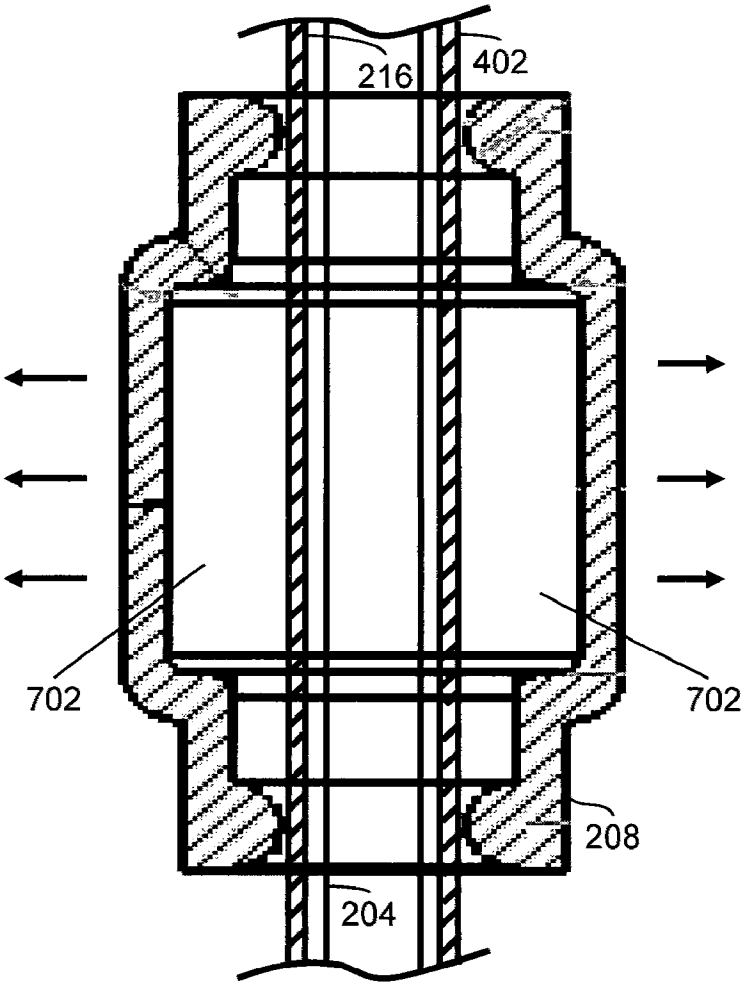
FIG. 7 illustrates a cross-sectional view of a dynamic seal, in accordance with an embodiment of the present invention.

FIG. 7 illustrates a cross-sectional view of the dynamic seal 208, in accordance with an embodiment of the present invention. In this embodiment, the dynamic seal 208 can be in an interference fit with the body portion 213. The dynamic seal 208 can be activated and can be made to seal the test tube 202 by filling the second pressurizing medium in a first space 702. The second pressurizing medium can flow from the inlet port 212 to the first space 702 via the connecting tube 214. As the second pressurizing medium reaches the first space 702, the dynamic seal 208 expands. As a result of the expansion, the outer diameter of the dynamic seal 208 increases. Consequently, the test tube 202 is sealed by the dynamic seal 208.

Figure 8:
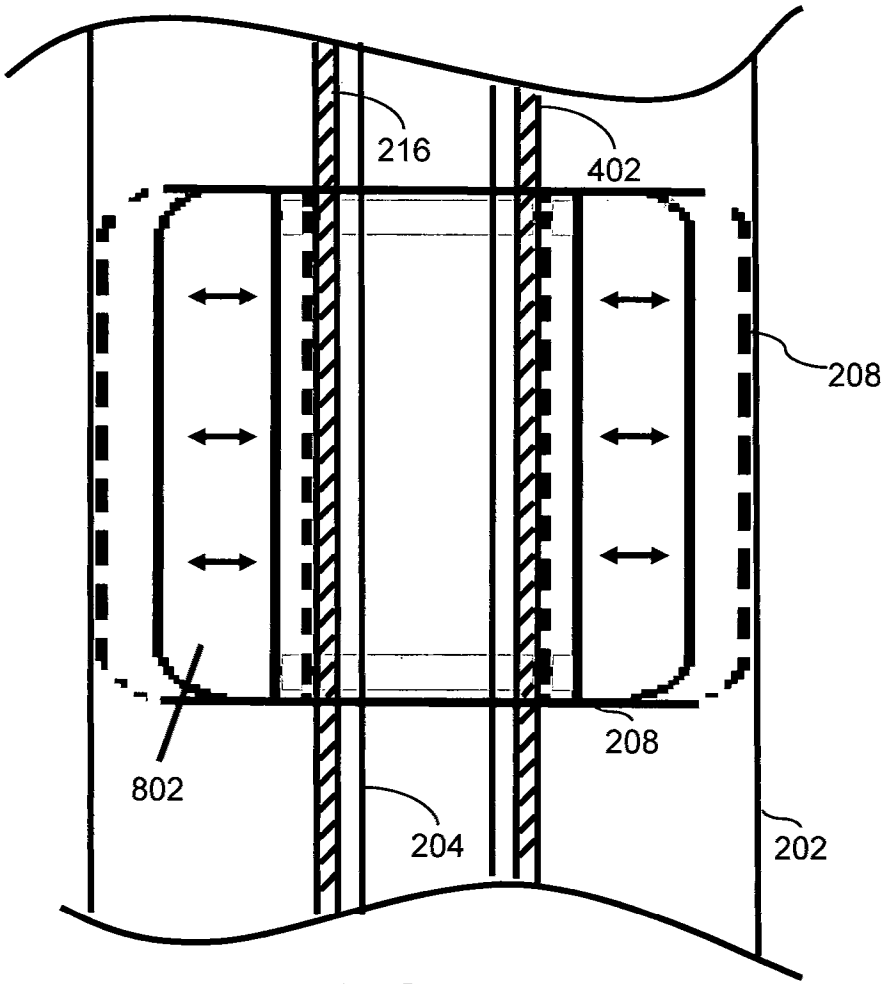
FIG. 8 illustrates a cross-sectional view of the dynamic seal, in accordance with another embodiment of the present invention.

FIG. 8 illustrates a cross-sectional view of the dynamic seal 208, in accordance with another embodiment of the present invention. In this embodiment, the dynamic seal 208 is hollow from inside and can be blown up, like a balloon, by the first pressurized fluid to seal the test tube 202. In one arrangement of this embodiment, the dynamic seal 208 can be in a loose fit with the body portion 213 and is held at the desired position with the help of nut 210 (Not shown in the FIG. 8). The nut 210 prevents the slippage or fall of the dynamic seal 208. In another arrangement of this embodiment, the dynamic seal 208 can be in an interference fit with the body portion 213. As the second pressurizing medium is filled inside a second space 802, the inner diameter decreases and the outer diameter increases. Consequently, the test tube 202 is sealed by the dynamic seal 208. For another embodiment, the dynamic seal 208 can be designed to seal the outer diameter of the test tube 202.

Figure 9:
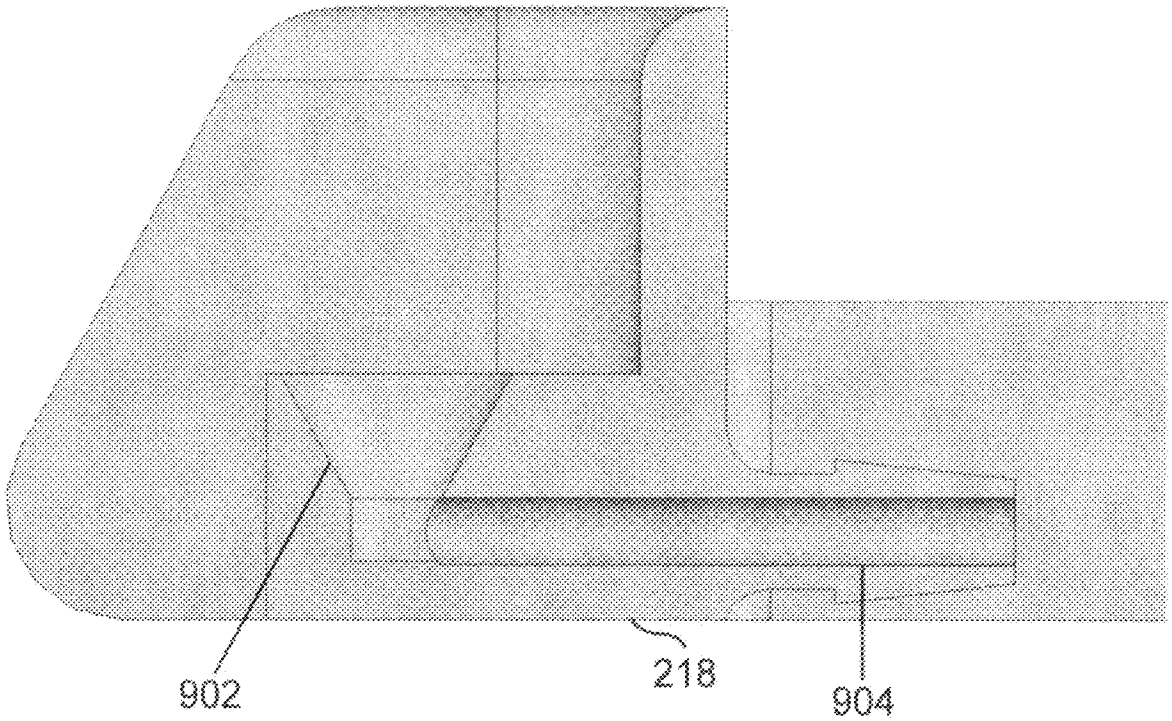
FIG. 9 illustrates a cross-sectional view of a holder, in accordance with an embodiment of the present invention.

FIG. 9 illustrates a diagram of the holder 218, in accordance with an exemplary embodiment of the present invention. In this embodiment, the holder 218 includes a drain system. For the purpose of this description, the drain system is shown to be in the form of a funnel 902 and a tube 904. However, it will be readily apparent to a person with ordinary skill in the art that the drain system can have a different shape and different components. The holder 218 can act as a drain when the tube arrangement 204 is being rinsed to remove the traces of last analyzed fluid after the tube 202 has been disengaged from the dynamic seal 208. Further, the holder includes a passage for flow of the rinsed fluid. For example, after a sample of urine has been analyzed and the test tube 202 disengaged from the dynamic seal 208, the tube arrangement 204 can be rinsed with the help of water. The funnel 902 and the tube 904, collectively, can act as a passage for the flow of the rinsed fluid. The funnel 902 collects the rinsed fluid from the tube arrangement 204. After collection of the rinsed fluid, the rinsed fluid flows to the tube 904. Further, the tube 904 can be connected to a drain (Not shown in the FIG. 9) with the help of a tube to flush the rinsed fluid to the drain. Further, those skilled in the art will appreciate that the design of holder 218 may be different from the design as shown in the FIG. 9. Further, those ordinarily skilled in the art will understand that the holder 218 may include additional components that are not shown here and are not germane to the operation of the holder 218, in accordance with the inventive arrangements. Furthermore, the holder 218 can be used as a sub-part in any laboratory instrument such as a flow cytometer.

Figure 10:
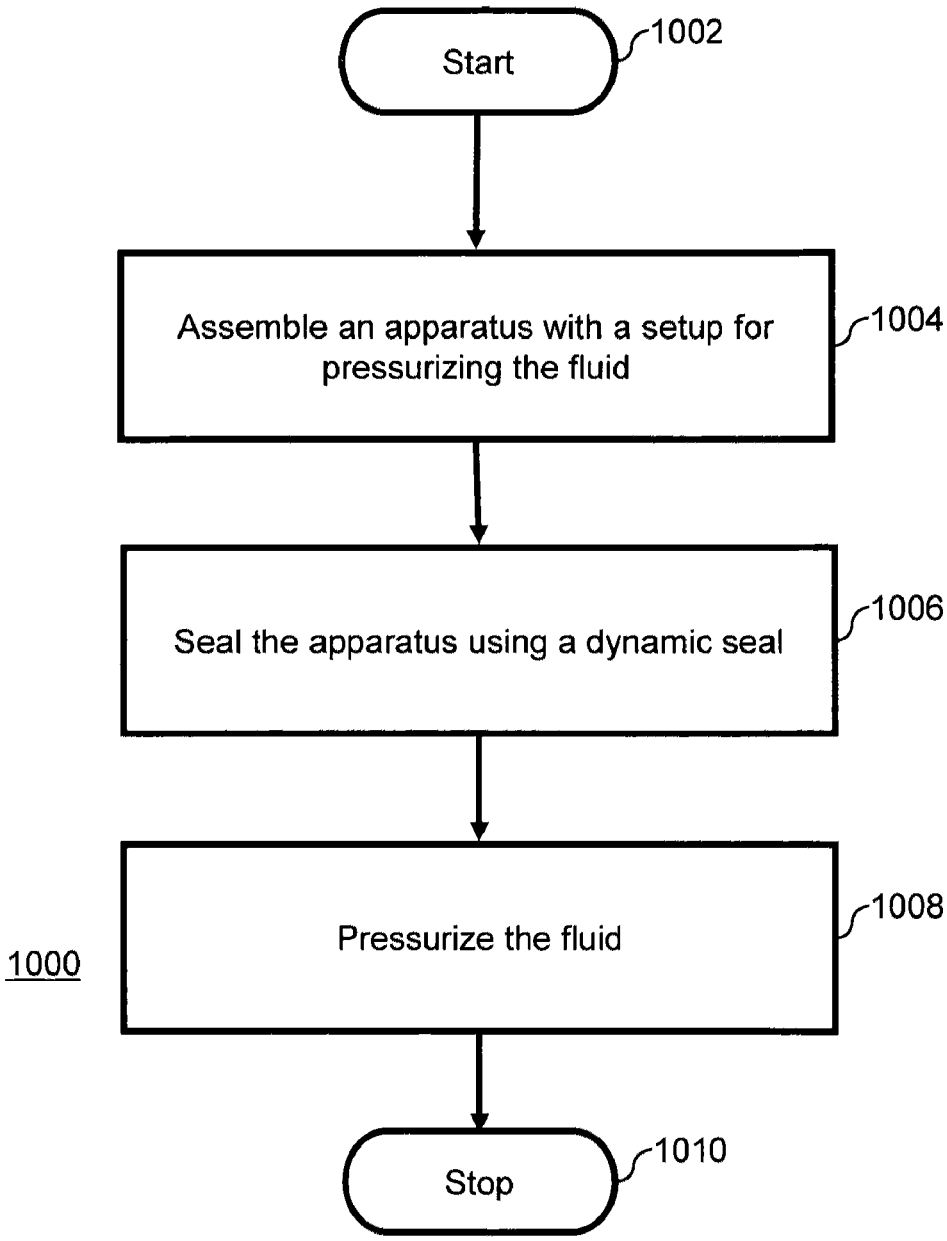
FIG. 10 is a flow diagram illustrating a method for pressurizing fluids, in accordance with an embodiment of the present invention.

FIG. 10 is a flow diagram illustrating a method 1000 for pressurizing the fluid 206, in accordance with an embodiment of the present invention. To describe the method 1000, reference will be made to FIG. 2, FIG. 3, FIG. 4, and FIG. 5, although it is understood that the method 1000 can be implemented in any other suitable environment. Moreover, the invention is not limited to the order in which the steps are listed in the method 1000.

The method 1000 for pressurizing the fluid 206 initiates at step 1002. For the sake of clarity, the method 1000 can be explained in conjunction with the container 202 as a test tube. However, the container 202 can be any laboratory instrument such as a conical flask, a beaker, and any other laboratory instrument. At step 1004, the test tube 202 is assembled with the arrangement 200 (as described and shown in the FIG. 2 and FIG. 3) for pressurizing the fluid 206. The arrangement 200 includes the dynamic seal 208, which can be held at its position by the nut 210 or by virtue of the interference fit with the tube arrangement 204.

At step 1006, the test tube 202 can be sealed using the dynamic seal 208. The test tube 202 can be sealed by activating/expanding the dynamic seal 208. The dynamic seal 208 can be activated by flow of the second pressurizing medium from the inlet port 212. For one embodiment, the second pressurizing medium flows via the connecting tube 214 to the first space 702 (shown in FIG. 7). After reaching the first space 702, the second pressurizing medium pressurizes the dynamic seal 208 to expand as a result of which the outer diameter of the dynamic seal 208 increases. Eventually, the test tube 202 is sealed due to increase in the outer diameter. For another embodiment, the second pressurizing medium flows to the second space 802 (shown in FIG. 8). The expansion of the dynamic seal 208 leads to a decrease in the inner diameter and an increase in the outer diameter of the dynamic seal 208. As a result, the test tube 202 is sealed.

At step 1008, the fluid 206 is pressurized with the help of a first pressurizing medium. The first pressurizing medium can be forced in the test tube 202 from the pressurization port 216. Further, the first pressurizing medium can pressurize the container as well as the fluid 206 inside the test tube 202. At step 1010, the method 1000 terminates.

Various embodiments of the present invention offer one or more advantages. The present invention provides a system and method for pressurizing a container. The invention eliminates the friction between the container and the seal. As a result of this, the container can be easily engaged and disengaged. Further, the invention overcomes the problem of breakage and loss to the sample caused due to application of extra pressure while forcefully engaging/disengaging the container. Furthermore, the invention eliminates the need of complicated auto-loader systems required for engaging and disengaging the container against the friction in case of a static interference seal such as an O-ring.

What is claimed is:

1. A system for pressurizing fluids in fluid analysis equipment, the system comprising:

a pressurization unit coupled to a flow cytometer and having a pressurization port configured to removeably couple to a container with an open end and a closed end, the container being removable from the system and containing the fluids to be pressurized and transported to the flow cytometer;

a dynamic seal, the dynamic seal being capable of expanding to facilitate sealing of the open end of the container;

the pressurization port having at least a vertical portion concentric to the dynamic seal and passing through the center of the dynamic seal, wherein the pressurization port is configured to facilitate passing of a first pressurizing medium to pressurize the fluids;

a tube arrangement concentric to the container and the vertical portion of the pressurization port, the tube arrangement passing through the dynamic seal into the container, wherein the tube arrangement facilitates passage of the fluids to the flow cytometer; and a holding mechanism comprising a holder supporting the closed end of the container, wherein the holder is configured to hold the closed end of the container in a first position to enable the dynamic seal to expand within the container, and further configured to swivel from the first position to a second position in which the closed end of the container is disengaged from the holder thereby enabling removal of the container.

2. The system according to claim 1, wherein the dynamic seal comprises:

an outer diameter, the outer diameter contacting an inner wall of the container upon expansion of the dynamic seal;

an inner diameter;

a first space enclosed by the inner diameter, the first space facilitating passage of the tube arrangement into the container; and a connecting tube means to apply a pressure using a second pressurizing medium to expand the dynamic seal.

3. The system according to claim 2, wherein a second space between the outer diameter and the inner diameter is filled with a solid substance.

4. The system according to claim 3 wherein the second pressurizing medium is blown into the second space to expand the dynamic seal.

5. The system according to claim 2, wherein the inner diameter and tube arrangement are in an interference fit.

6. The system according to claim 1 wherein the holder is coupled to a spring configured to maintain the holder in the first position via constant spring force.

7. The system according to claim 1 wherein the holder is supported by an elongated support that is extends parallel to the tube arrangement.

8. The system according to claim 1, wherein the holder includes a fluid passage configured to fluidically couple to the tube arrangement when the holder is brought back to the first position after removal of the container thereby enabling fluid to drained from the tube arrangement.

9. The system according to claim 1 wherein the container having the open end and the closed end comprises a test tube.

10. A system for pressurizing fluids, said system for pressurizing fluids including:

a) a dynamic seal, the dynamic seal being capable of expanding to facilitate sealing of an open end of a container, the dynamic seal having an outer diameter, the outer diameter contacting an inner wall of the container upon expansion of the dynamic seal; an inner diameter; a first space enclosed by the inner diameter, the first space facilitating passage of a tube arrangement into the container;

b) a pressurization port having at least a vertical portion concentric to the dynamic seal and passing through the center of the dynamic seal, wherein the pressurization port is configured to facilitate passing of a first pressurizing medium to pressurize the fluids;

c) a connecting tube to apply a pressure using a second pressurizing medium to expand the dynamic seal; and d) the tube arrangement concentric to the container and the vertical portion of the pressurization port, the tube arrangement passing through the dynamic seal into the container, wherein the tube arrangement facilitates passage of the fluids to the outside of the container; and a holding mechanism comprising a holder supporting a closed end of the container, wherein the holder is configured to hold the closed end of the container in a first position to enable the dynamic seal to expand within the container, and further configured to swivel from the first position to a second position in which the closed end of the container is disengaged from the holder thereby enabling removal of the container, wherein the holder includes a fluid passage configured to fluidically couple to the tube arrangement when the holder is brought back to the first position after removal of the container thereby enabling fluid to drained from the tube arrangement.

11. The system according to claim 10 further comprising a flow cytometer.

12. The system according to claim 10 wherein the container having the open end and the closed end comprises a test tube.

13. The system according to claim 10 wherein the dynamic seal comprises a polymer.

* * * * *